US011371768B2

(12) United States Patent
Song et al.

(10) Patent No.: US 11,371,768 B2
(45) Date of Patent: Jun. 28, 2022

(54) REFRIGERATOR AND METHOD FOR CONTROLLING THE SAME

(71) Applicant: LG ELECTRONICS INC., Seoul (KR)

(72) Inventors: Youngseung Song, Seoul (KR); Namsoo Cho, Seoul (KR); Kangsoo Byun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 156 days.

(21) Appl. No.: 16/728,705

(22) Filed: Dec. 27, 2019

(65) Prior Publication Data

US 2020/0208898 A1 Jul. 2, 2020

(30) Foreign Application Priority Data

Dec. 28, 2018 (KR) ..... 10-2018-0172587
Dec. 28, 2018 (KR) ..... 10-2018-0172603

(51) Int. Cl.
*F25D 11/02* (2006.01)
*F25D 17/06* (2006.01)

(52) U.S. Cl.
CPC ..... *F25D 11/025* (2013.01); *F25D 17/065* (2013.01); *F25D 2600/04* (2013.01)

(58) Field of Classification Search
CPC ..... F25D 17/065; F25D 2600/04; F25D 2600/112; F25D 2600/2511; F25D 2600/02; F25D 29/00; F25D 11/025
See application file for complete search history.

(56) References Cited

U.S. PATENT DOCUMENTS 6,327,867 B1 * 12/2001 Hyodo ..... F25B 5/04 62/187
9,080,805 B2 * 7/2015 Yanagida ..... F25D 29/00
2007/0068180 A1 * 3/2007 Yoon ..... F25B 5/00 62/200
2007/0227166 A1 * 10/2007 Rafalovich ..... F25B 5/02 62/199

(Continued)

FOREIGN PATENT DOCUMENTS

EP 2 395 304 12/2011
EP 2592372 5/2013

(Continued)

OTHER PUBLICATIONS

European Office Action dated Mar. 2, 2022 issued in Application No. 19219798.6.

*Primary Examiner* — Kun Kai Ma
(74) *Attorney, Agent, or Firm* — KED & Associates LLP

(57) ABSTRACT

A method of controlling a refrigerator may include operating a first cooling cycle for a first storage compartment to drive a compressor and operating a first cooling fan for cooling the first storage compartment, and switching to a second cooling cycle for cooling a second storage compartment to drive the compressor and operating a second cooling fan for cooling the second storage compartment when a stop condition of the first cooling cycle is satisfied. The method may also include switching to a third cooling cycle for cooling the first storage compartment to drive the compressor and operating the first cooling fan when a stop condition of the second cooling cycle is satisfied.

20 Claims, 5 Drawing Sheets

(56) References Cited

U.S. PATENT DOCUMENTS

| | | | | |
|---|---|---|---|---|
| 2010/0100243 | A1* | 4/2010 | Lee | F25D 29/00 700/275 |
| 2011/0302938 | A1* | 12/2011 | Lee | F25D 29/00 62/89 |
| 2015/0168040 | A1* | 6/2015 | Kang | F25D 17/065 62/66 |
| 2019/0120533 | A1* | 4/2019 | Lee | F25D 29/00 |
| 2019/0128597 | A1* | 5/2019 | Kim | F25D 17/065 |
| 2019/0128598 | A1* | 5/2019 | Song | F25D 17/045 |
| 2019/0301786 | A1* | 10/2019 | Lee | F25B 5/02 |
| 2019/0316828 | A1* | 10/2019 | Kosakowski | F25D 11/003 |
| 2020/0088462 | A1* | 3/2020 | Ahn | F25D 11/022 |
| 2020/0166259 | A1* | 5/2020 | Seong | F25D 11/022 |
| 2020/0208898 | A1* | 7/2020 | Song | F25D 11/025 |
| 2020/0224955 | A1* | 7/2020 | Park | F25D 17/065 |
| 2020/0318882 | A1* | 10/2020 | Lee | F25D 29/00 |
| 2021/0222946 | A1* | 7/2021 | Kulkarni | F25D 17/067 |

FOREIGN PATENT DOCUMENTS

| | | |
|---|---|---|
| KR | 10-2011-0136102 | 12/2011 |
| KR | 10-2018-0065192 | 6/2018 |
| WO | WO 96/15413 | 5/1996 |

* cited by examiner

REFRIGERATOR AND METHOD FOR CONTROLLING THE SAME

CROSS-REFERENCE TO RELATED APPLICATION

The present application claims priority under 35 U.S.C. § 119 and 35 U.S.C. § 365 to Korean Patent Application No. 10-2018-0172587, filed Dec. 28, 2018, and Korean Patent Application No. 10-2018-0172603, filed Dec. 28, 2018, the subject matters of which are hereby incorporated by reference in its entirety.

BACKGROUND

1. Field

The present disclosure relates to a refrigerator and a control method thereof.

2. Background

A refrigerator is a home appliance capable of storing an object (such as food) at a low temperature in a storage compartment provided in a cabinet. Since the storage compartment is surrounded by a heat insulating wall, the interior of the storage compartment may be maintained at a temperature lower than an external temperature. The storage compartment may be divided into a refrigerating compartment or a freezing compartment according to temperature bands of the storage compartment.

A refrigerator in which a freezing compartment and a refrigerating compartment are provided with evaporators, respectively, have been developed. Such a refrigerator allows refrigerant to flow to one of the evaporators of the freezing compartment and the refrigerating compartment, and then to the other evaporator.

Korean Patent Publication No. 10-2018-0065192, the subject matter of which is incorporated herein by reference, discloses a refrigerator and a control method thereof. In this disclosure, a refrigerating cycle is started when a start condition of the refrigerating cycle is satisfied while a freezing cycle is being operated. A freezing compartment fan is operated during operation of the freezing cycle, and continues to be operated without being stopped even after the refrigerating cycle is started.

When the freezing compartment fan is operated after the freezing cycle is stopped, the refrigerant of a freezing compartment evaporator may be collected into a compressor, and air is cooled by latent heat of evaporation of the freezing compartment evaporator, so that cooling of the freezing compartment may be maintained for a predetermined time. The freezing compartment fan is operated while maintaining a previous output (i.e., an output in the refrigerating cycle) until a stop condition of the freezing compartment fan is satisfied.

However, the temperature of the freezing compartment evaporator may rise during operation of the freezing compartment fan, and thus difference in temperature between the freezing compartment and the freezing compartment evaporator decreases to reduce the heat exchange efficiency, but output of the freezing compartment fan remains the same as before, which may leading to a disadvantage that unnecessary power consumption is caused by operation of the freezing compartment fan.

BRIEF DESCRIPTION OF THE DRAWINGS

Arrangements and embodiments may be described in detail with reference to the following drawings in which like reference numerals refer to like elements and wherein.

DETAILED DESCRIPTION

Figure 1:
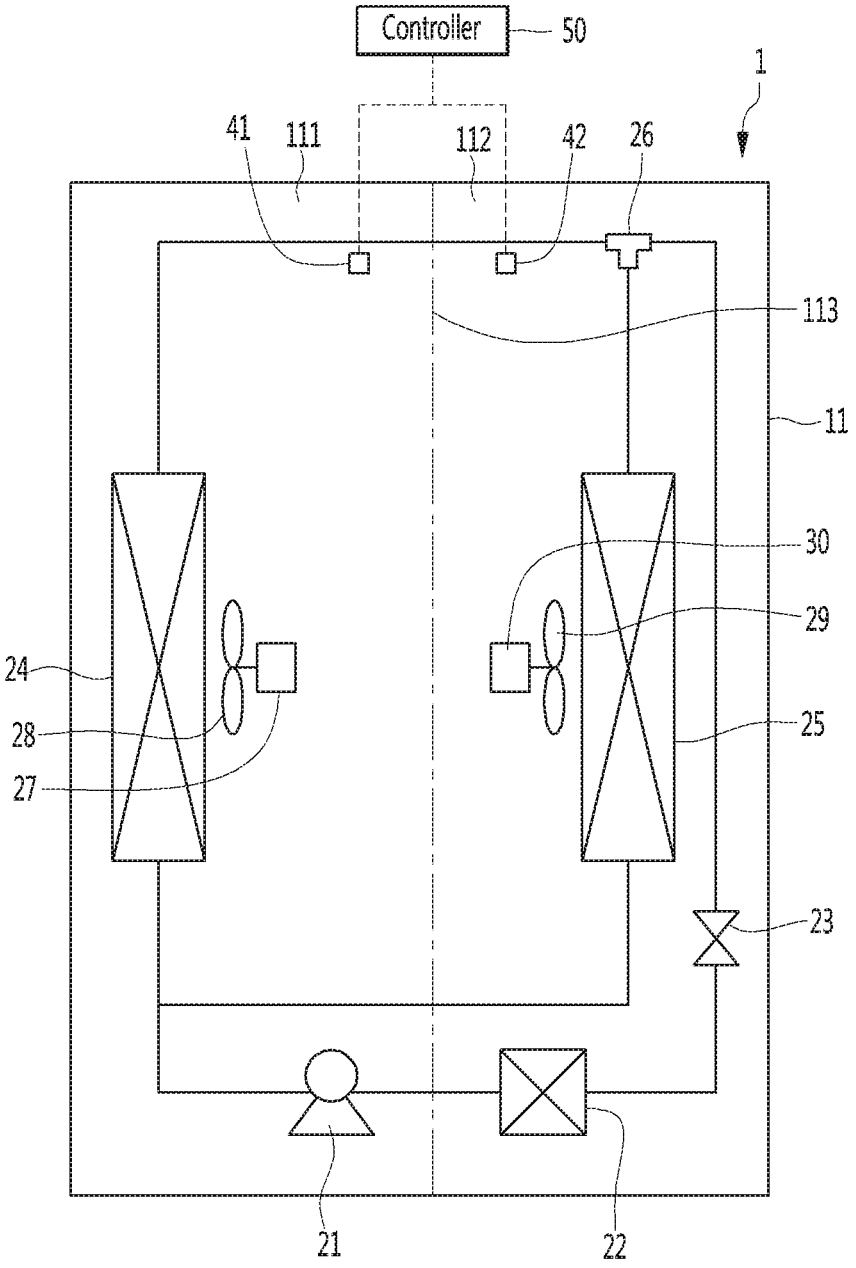
FIG. 1 is a view schematically showing a configuration of a refrigerator according to an embodiment of the present disclosure.
Figure 2:
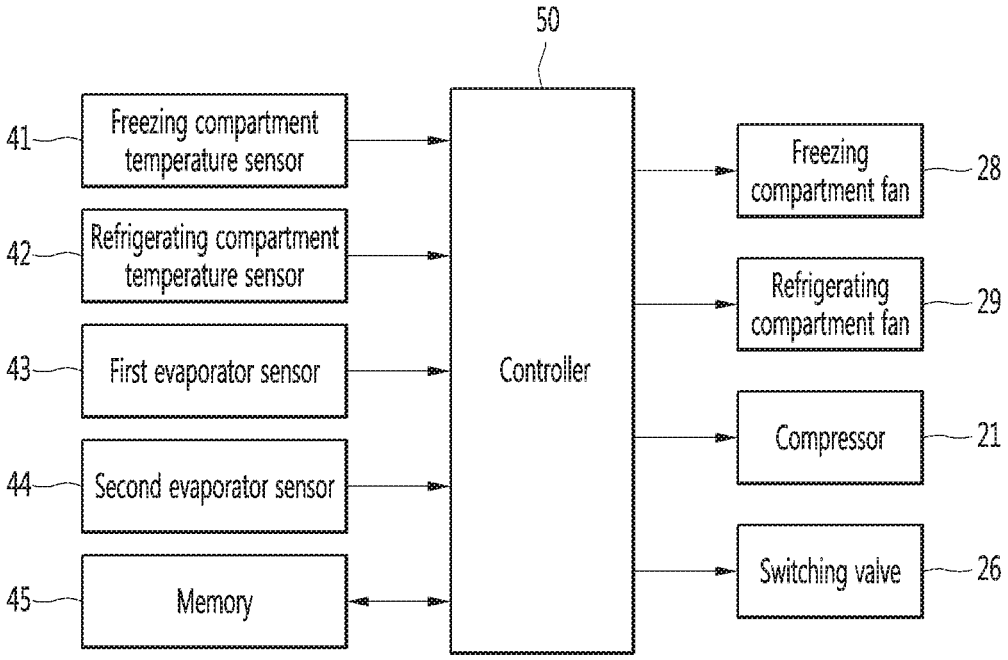
FIG. 2 is a block diagram of a refrigerator according to an embodiment of the present disclosure.

FIG. 1 is a view schematically showing a configuration of a refrigerator according to an embodiment of the present disclosure. FIG. 2 is a block diagram of a refrigerator according to an embodiment of the present disclosure. Other embodiments and configurations may also be provided.

A refrigerator 1 according to an embodiment of the present disclosure may include a cabinet 10 having a freezing compartment 111 and a refrigerating compartment 112 formed therein and doors coupled to the cabinet 10 to open and close the freezing compartment 111 and the refrigerating compartment 112, respectively. The freezing compartment 111 and the refrigerating compartment 112 may be provided by partitioning the cabinet 10 in the left-right direction or the up-down direction in the cabinet 10 by a partition wall 113.

The refrigerator 1 may include a compressor 21, a condenser 22, an expansion member 23, a freezing compartment evaporator 24 (also referred to as a second evaporator) for cooling the freezing compartment 111, and a refrigerating compartment evaporator 25 (also referred to as a first evaporator) for cooling the refrigerating compartment 112. The refrigerator 1 may include a switching valve 26 (or switch device) for allowing refrigerant passing through the expansion member 23 to flow into any one of the freezing compartment evaporator 24 and the refrigerating compartment evaporator 25.

A state in which the switching valve 26 is operated (or controlled) to enable the refrigerant to flow into the refrigerating compartment evaporator 25 may be referred to as a first state of the switching valve 26. A state in which the switching valve 26 is operated (or controlled) to enable the refrigerant to flow into the freezing compartment evaporator 24 may be referred to as a second state of the switching valve 26. The switching valve 26 may be a three way valve, for example.

The switching valve 26 may selectively open one of a first refrigerant passage connecting the compressor 21 and the refrigerating compartment evaporator 25 to enable the refrigerant to flow and a second refrigerant passage connecting the compressor 21 and the freezing compartment evaporator 24 to enable the refrigerant to flow. The cooling of the refrigerating compartment 112 and the cooling of the freezing compartment 111 may be alternately performed by the switching valve 26.

The refrigerator 1 may include a freezing compartment fan 28 (also referred to as a second cooling fan) for blowing air to the freezing compartment evaporator 24, a second motor for rotating the freezing compartment fan 28, a refrigerating compartment fan 29 (also referred to as a first cooling fan) for blowing air to the refrigerating compartment evaporator 25 and a first motor 30 for rotating the refrigerating compartment fan 29.

A freezing cycle may include a series of cycles through which the refrigerant flows through the compressor 21, the condenser 22, the expansion member 23, and the freezing compartment evaporator 24. A refrigerating cycle may include a series of cycles through which the refrigerant flows through the compressor 21, the condenser 22, the expansion member 23 and the refrigerating compartment evaporator 25.

The "refrigerating cycle is operated" may mean that the compressor 21 is turned on, the refrigerating compartment fan 29 is rotated, and the refrigerant flows through the refrigerating compartment evaporator 25 based on the switching valve 26 so that the refrigerant flowing through the refrigerating compartment evaporator 25 is heat exchanged with air. The "freezing cycle is operated" may mean that the compressor 21 is turned on, the freezing compartment fan 28 is rotated, and the refrigerant flows through the freezing compartment evaporator 24 based on the switching valve 26 so that the refrigerant flowing through the freezing compartment evaporator 24 is heat exchanged with air.

In the above description, one expansion member 23 is located upstream of the switching valve 26. In at least one embodiment, a first expansion member may be provided between the switching valve 26 and the refrigerating compartment evaporator 25, and a second expansion member may be provided between the switching valve 26 and the freezing compartment evaporator 24.

As another example, the switching valve 26 may not used, and a refrigerating compartment valve (a first valve) may be provided on the inlet side of the refrigerating compartment evaporator 25, and a freezing compartment valve (a second valve) may be provided on the inlet side of the freezing compartment evaporator 24. In operation of the freezing cycle, the freezing compartment valve may be turned on and the refrigerating compartment valve may be turned off. In operation of the refrigerating cycle, the freezing compartment valve may be turned off and the refrigerating compartment valve may be turned on.

The refrigerator 1 may include a freezing compartment temperature sensor 41 for sensing a temperature of the freezing compartment 111, a refrigerating compartment temperature sensor 42 for sensing a temperature of the refrigerating compartment 112, an input interface capable of receiving set temperatures (or a target temperatures) of the freezing compartment 111 and the refrigerating compartment 112 and a controller 50 for controlling a cooling cycle (i.e., the freezing cycle or the refrigerating cycle) based on the input set temperatures and the temperatures detected by the temperature sensors 41 and 42.

The refrigerator 1 may include one or all of a first evaporator sensor 43 for detecting a temperature of the refrigerating compartment evaporator 25 (or a temperature around the refrigerating compartment evaporator 25), and a second evaporator sensor 44 for detecting a temperature of the freezing compartment evaporator 24 (or a temperature around the freezing compartment evaporator 24).

A temperature lower than a set temperature of the freezing compartment 111 may be referred to as a first freezing compartment reference temperature (or a third reference temperature). A temperature higher than the set temperature of the freezing compartment 111 may be referred to as a second freezing compartment reference temperature (or a fourth reference temperature). A range between the first freezing compartment reference temperature and the second freezing compartment reference temperature may be referred to as a set temperature range of the freezing compartment. In at least one non-limiting example, the set temperature of the freezing compartment 111 may be an average temperature of the first freezing compartment reference temperature and the second freezing compartment reference temperature.

A temperature lower than a set temperature of the refrigerating compartment 112 may be referred to as a first refrigerating compartment reference temperature (or a first reference temperature), and a temperature higher than the set temperature of the refrigerating compartment 112 may be referred to as a second refrigerating compartment reference temperature (or a second reference temperature). A range between the first refrigerating compartment reference temperature and the second refrigerating compartment reference temperature may be referred to as a set temperature range of the refrigerating compartment. In at least one non-limiting example, the set temperature of the refrigerating compartment 112 may be an average temperature of the first refrigerating compartment reference temperature and the second refrigerating compartment reference temperature.

The user may set the set temperatures of the freezing compartment 111 and the refrigerating compartment 112.

The controller 50 may control the temperature of the refrigerating compartment 112 to be maintained within a range of a temperature-satisfied interval that falls within the refrigerating compartment set temperature range. The controller 50 may control the temperature of the freezing compartment 111 to be maintained within a range of a temperature-satisfied interval that falls within the freezing compartment set temperature range.

An upper limit temperature of the temperature-satisfied interval may be set to be equal to or lower than the second refrigerating compartment reference temperature. A lower limit temperature may be set to be equal to or higher than the first refrigerating compartment reference temperature.

The controller 50 may perform control such that a first refrigerating cycle, a freezing cycle, the second refrigerating cycle and a pump down operation constitute one operation period. The controller 50 may also perform control such that the first refrigerating cycle, the freezing cycle, the second refrigerating cycle, the pump down operation, and the stopping of the compressor for a predetermined time may constitute one operation period.

The refrigerating compartment 112 may be referred to as a first storage compartment. The freezing compartment 111 may be referred to as a second storage compartment.

The first refrigerating cycle is a cooling cycle for cooling the first storage compartment, and may be referred to as a first cooling cycle. The freezing cycle is a cooling cycle for cooling the second storage compartment, and may be referred to as a second cooling cycle. The second refrigerating cycle is a cooling cycle for cooling the first storage compartment, and may be referred to as a third cooling cycle.

The pump down operation may be an operation of driving the compressor 21 to collect the refrigerant remaining in the evaporators 24 and 25 into the compressor 21 when the supply of refrigerant to the evaporators 24 and 25 is blocked.

The controller 50 may operate the first refrigerating cycle, and when a stop condition of the first refrigerating cycle (also referred to as a start condition of the freezing cycle) is satisfied, the controller 50 may operate the freezing cycle.

When a stop condition of the freezing cycle is satisfied while operating the freezing cycle, the controller 50 may operate the second refrigerating cycle. When the stop condition of the second refrigerating cycle is satisfied, the pump down operation may be performed.

The smaller the set temperature range, the smaller the temperature change range of the food, so that freshness of the food is improved. However, as the set temperature range is smaller, a switching period of the switching valve 26 is shorter, and a period of the pump down operation is also shorter. Since the pump down operation is not an operation for cooling the storage compartment, when the period of the pump down operation is shortened, the pump down operating time relatively increases. Thus, power consumption may increase.

A control method of the refrigerator may be provided for reducing power consumption. In at least one non-limiting example, power consumption may be reduced by controlling the refrigerating compartment fan 29, for example.

The refrigerator 1 may include a memory 45 in which temperatures of the freezing compartment 111 and the refrigerating compartment 112 are stored during the cooling cycle. The memory 45 may store reference time information and/or reference temperature values for control of outputs of the compartment fans 28 and 29 (i.e., cooling fans) to be described below.

Figure 3:
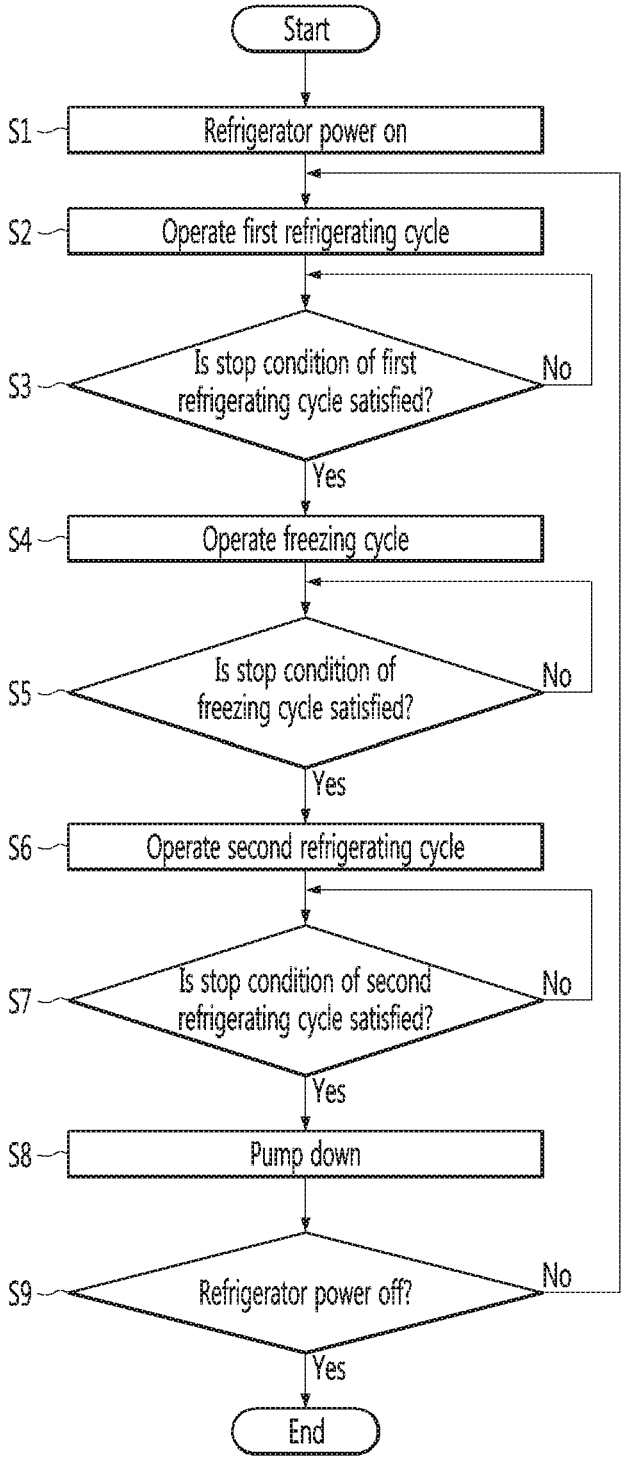
FIG. 3 is a flowchart for schematically describing a method of controlling a refrigerator according to an example embodiment of the present disclosure.
Figure 4:
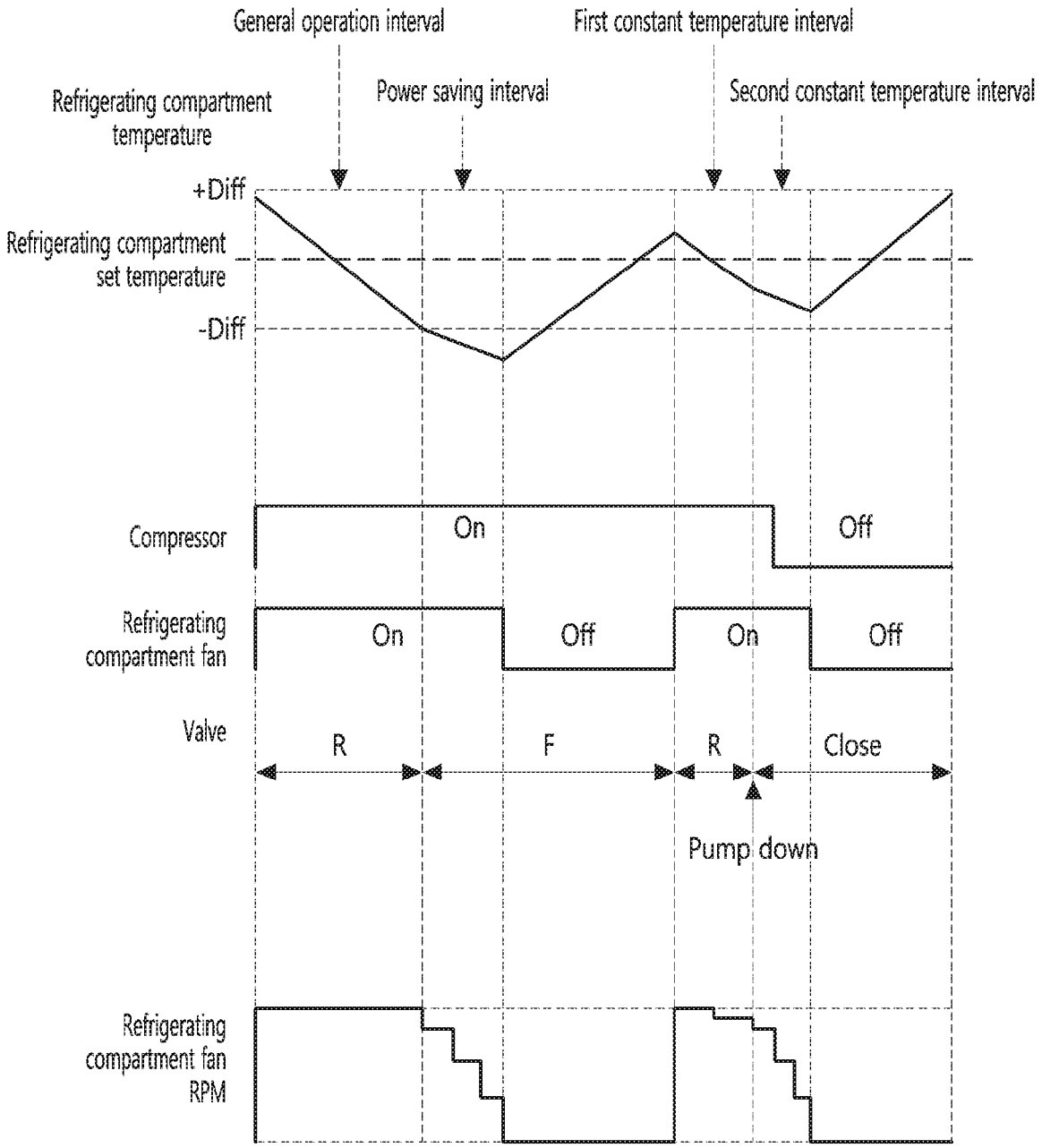
FIG. 4 shows a change in a refrigerating compartment temperature and a change in output of a refrigerating compartment fan during operation of a cooling cycle.
Figure 5:
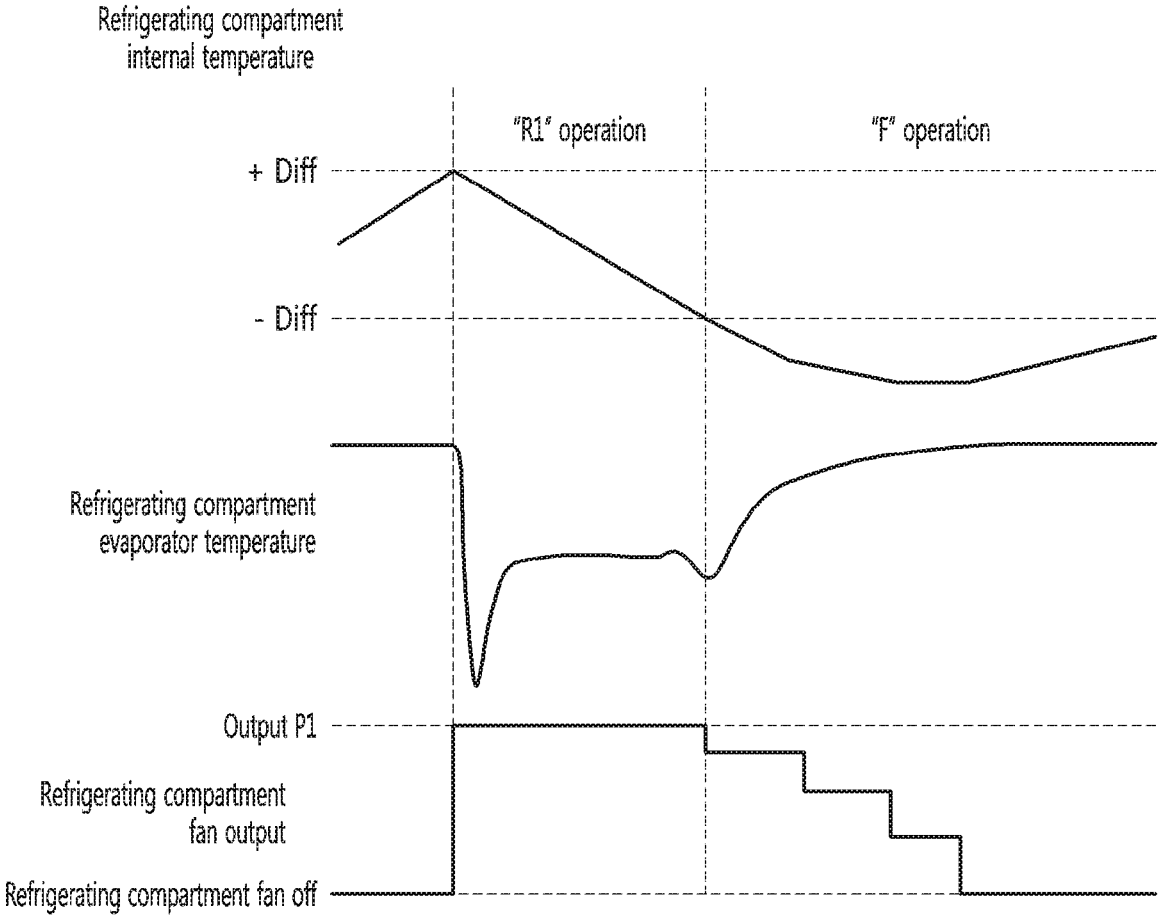
FIG. 5 shows a change in temperature of an evaporator for a refrigerating compartment during operation of a cooling cycle.

FIG. 3 is a flowchart for schematically describing a method of controlling a refrigerator according to an example embodiment of the present disclosure. FIG. 4 shows a change in a refrigerating compartment temperature and a change in output of a refrigerating compartment fan during operation of a cooling cycle. FIG. 5 shows a change in temperature of an evaporator for a refrigerating compartment during operation of a cooling cycle. Other embodiments and configurations may also be provided.

As shown in FIG. 3, power of the refrigerator 1 is turned on (S1). When the power of the refrigerator 1 is turned on, the refrigerator 1 may operate to cool the freezing compartment 111 or the refrigerating compartment 112. A method of controlling a refrigerator by cooling the freezing compartment 111 after cooling the refrigerating compartment 112 may be described as one example.

In order to cool the refrigerating compartment 112, the controller 50 may control or operate a first refrigerating cycle (S2). For example, the controller 50 may turn on the compressor 21 and rotate the refrigerating compartment fan 29. The switching valve 26 is switched to (or provided in) a first state such that refrigerant flows to the refrigerating compartment evaporator 25. In at least one non-limiting embodiment, a refrigerating compartment valve may be turned on and a freezing compartment valve may be turned off.

The refrigerating compartment fan 29 may be operated to provide a first reference output during the first refrigerating cycle. The output of the refrigerating compartment fan 29 may be a number of rotations, for example. Therefore, adjusting the output of the refrigerating compartment fan 29 may include (or mean) adjusting the number of rotations. Stated differently, power for the refrigerating compartment fan may be controlled to adjust the number of rotations. The power to the refrigerating compartment fan may be an initial output and/or a reduced output, for example. The output, as used hereafter, may refer to the power to the fan. The freezing compartment fan 28 may remain stationary when the first refrigerating cycle is operating.

The refrigerant compressed by the compressor 21 and passed through the condenser 22 may flow to the refrigerating compartment evaporator 25 through the switching valve 26. The refrigerant evaporated while flowing through the refrigerating compartment evaporator 25 may flow back into the compressor 21.

Air which is heat exchanged with refrigerant in the refrigerating compartment evaporator 25 may be supplied to the refrigerating compartment 112. Therefore, temperature of the refrigerating compartment 112 may decrease, while the temperature of the freezing compartment 111 may increase.

During a time in which the first refrigerating cycle is being operated, the controller 50 may determine whether a stop condition of the first refrigerating cycle is satisfied (or determined) (S3). That is, the controller 50 may determine whether a start condition of the freezing cycle is satisfied. For example, the controller 50 may determine that the stop condition of the refrigerating cycle is satisfied when the temperature of the refrigerating compartment 112 is lower than or equal to a first refrigerating compartment reference temperature (−Diff).

When it is determined at S3 that the stop condition of the first refrigerating cycle is satisfied, the controller 50 may operate the freezing cycle (S4). For example, the controller 50 may switch the switching valve 26 to a second state such that the refrigerant flows to the freezing compartment evaporator 24. In at least one non-limiting example, the freezing compartment valve may be turned on and the refrigerating compartment valve is turned off. Additionally, the freezing compartment fan 28 may be operated.

However, even when switching from the first refrigerating cycle to the freezing cycle is performed, the compressor 21 may be continuously driven without being stopped. Additionally, even when switching from the first refrigerating cycle to the freezing cycle is performed, the refrigerating compartment fan 29 is continuously operated without being stopped.

The freezing compartment fan 28 may operate at the same time as the refrigerating compartment fan 29 is stopped or after the refrigerating compartment fan 29 is stopped.

When the refrigerating compartment fan 29 is continuously operated even after operation of the first refrigerating cycle is stopped, air may be cooled by the latent heat of evaporation of the refrigerating compartment evaporator 25 so that the refrigerating compartment 112 may be cooled. Therefore, even when the first refrigerating cycle is stopped, the refrigerating compartment 112 may be cooled, and the rising of the temperature of the refrigerating compartment 112 may be delayed.

FIG. 5 shows that after the first refrigerating cycle is stopped, the temperature of the refrigerating compartment evaporator 25 increases as time elapses based on operation of the refrigerating compartment fan 29.

When the temperature of the refrigerating compartment evaporator 25 increases, a difference between the temperature of the refrigerating compartment 112 and the temperature of the refrigerating compartment evaporator 25 may be reduced, thereby reducing heat exchange efficiency. When the heat exchange efficiency is reduced in this manner, and when the refrigerating compartment fan 29 is operated while the output of the refrigerating compartment fan 29 is maintained at the previous output, unnecessary power consumption may be caused.

In at least one example, control may be performed to reduce the output of the refrigerating compartment fan 29 in consideration of the rising of the temperature of the refrigerating compartment evaporator 25, during the operation of the freezing cycle. As an example, the output of the refrigerating compartment fan 29 may be reduced stepwise until the refrigerating compartment fan 29 is stopped. FIG. 4 shows a power saving interval.

However, when the refrigerator door is opened, a defrosting operation for defrosting the evaporator is started, or the set temperature is changed through the input device after the refrigerating cycle is operated, control for reducing the output of the refrigerating compartment fan 29 may not be performed until the temperature of the refrigerating compartment 112 reaches a predetermined temperature.

In the above example, since there is a high possibility that the temperature of the refrigerating compartment 112 increases, control for reducing the output of the refrigerating compartment fan 29 may not be performed and the refrigerating compartment fan 29 may be operated at a normal output.

First Example of Output Control for Refrigerating Compartment Fan in Freezing Cycle Operation In at least one non-limiting example, the output of the refrigerating compartment fan 29 may be reduced stepwise over time. For example, the refrigerating compartment fan 29 may operate at a first initial output during operation of the freezing cycle.

When a first reference time T1 elapses (when an output reduction condition is satisfied) while the refrigerating compartment fan 29 is operating at the first initial output, the refrigerating compartment fan 29 may then be operated at a first reduced output lower than the first initial output.

When a second reference time T2 elapses (when a first additional reduction condition is satisfied) while the refrigerating compartment fan 29 is operating at the first reduced output, the refrigerating compartment fan 29 may then be operate at a second reduced output lower than the first reduced output.

When a third reference time T3 elapses (when a second additional reduction condition is satisfied) while the refrigerating compartment fan 29 is operating at the second reduced output, the refrigerating compartment fan 29 may then stop or be operated at a third reduced output lower than the second reduced output. When the refrigerating compartment fan 29 is operated at the third reduced output, the refrigerating compartment fan 29 may then stop after a set time has elapsed.

In the present embodiment, the output of the refrigerating compartment fan 29 may be reduced at least two times or more from the first initial output. For example, the first initial output may be equal to or less than the first reference output.

When the first initial output is lower than the first reference output, a first difference value between the first reference output and the first initial output may be smaller than or equal to a second difference value between the first initial output and the first reduced output. That is, an output reduction width from the first initial output to the first reduced output may be larger than or equal to an output reduction width from the first reference output to the first initial output.

The second difference value between the first initial output and the first reduced output may be smaller than or equal to a third difference value between the first reduced output and the second reduced output. That is, an output reduction width from the first reduced output to the second reduced output may be larger than or equal to the output reduction width from the first initial output to the first reduced output.

FIG. 5 shows that the output of the refrigerating compartment fan 29 may be reduced stepwise, and the output reduction width may be increased or remain constant.

The second reference time T2 may be shorter than or equal to the first reference time T1. The third reference time T3 may be shorter or equal to the second reference time T2. The output of the refrigerating compartment fan 29 may be reduced stepwise, and a length of the reference time for output reduction may be reduced stepwise or constant.

Since the temperature of the refrigerating compartment evaporator is the lowest after the start of the freezing cycle, the first initial output may be set to be higher than the other reduced outputs, and the first reference time may be set to be longer than the remaining reference times in order to make the most use of latent heat of evaporation. These reference times may be stored in the memory 45.

The output of the refrigerating compartment fan 29 is reduced stepwise, thereby reducing power consumption. As another example, the refrigerating compartment fan 29 may be continuously operated at the minimum output (e.g., the third reduced output) until the stop condition of the second cooling cycle is satisfied without being stopped after the output of the refrigerating compartment fan 29 has been reduced stepwise.

Second Example of Output Control for Refrigerating Compartment Fan in Freezing Cycle Operation As another non-limiting example, during operation of the freezing cycle, the output of the refrigerating compartment fan 29 may be reduced stepwise based on the temperature detected by the first evaporator sensor 43. For example, the refrigerating compartment fan 29 may operate at a first initial output during operation of the freezing cycle. When the temperature detected by the first evaporator sensor 43 is determined to be higher than a first reference temperature value (i.e., when an output reduction condition is satisfied) while the refrigerating compartment fan 29 is operating at the first initial output, the refrigerating compartment fan 29 may then be operated at a first reduced output lower than the first initial output.

When the temperature detected by the first evaporator sensor 43 is determined to be higher than a second reference temperature value higher than the first reference temperature value (i.e., when a first additional reduction condition is satisfied) while the refrigerating compartment fan 29 is operating at the first reduced output, the refrigerating compartment fan 29 may then be operated at a second reduced output lower than the first reduced output.

When the temperature detected by the first evaporator sensor 43 is determined to be higher than a third reference temperature value higher than the second reference temperature value (when a second additional reduction condition is satisfied) while the refrigerating compartment fan 29 is operating at the second reduced output, the refrigerating compartment fan 29 may then stop or be operated at a third reduced output lower than the second reduced output.

When the refrigerating compartment fan 29 is operated at the third reduced output, the refrigerating compartment fan 29 may then be turned off after a set time has elapsed.

A relationship in magnitude among the first initial output, the first reference output, the first and the second reduced outputs is the same as described above with respect to the first example. Thus, a detailed description thereof may be omitted.

In the second example, a difference value between the first reference temperature value and the second reference temperature value may be set to be equal to or larger than a difference value between the second reference temperature value and the third reference temperature value.

As one non-limiting example, since the temperature of the refrigerating compartment evaporator is the lowest after the start of the freezing cycle, the first initial output may be set to be higher than the other reduced outputs, and the reference temperature values may be set such that a time during which the refrigerating compartment fan is operated at the first initial output is the longest of times during which the refrigerating compartment fan is operated at the remaining reduced outputs in order to make the most use of the latent heat of evaporation. These reference temperature values may be stored in the memory 45.

Third Example of Output Control for Refrigerating Compartment Fan in Freezing Cycle Operation During operation of the freezing cycle, the output of the refrigerating compartment fan 29 may be reduced stepwise based on the temperature detected by the first evaporator sensor 43 and the temperature of the refrigerating compartment detected by the refrigerating compartment temperature sensor 42.

As shown in FIG. 5, after the freezing cycle is started, the temperature of the refrigerating compartment 112 may decrease and then increase, and the temperature detected by the first evaporator sensor 43 may increase and then be maintained at a constant temperature. That is, after the start of the freezing cycle, the difference between the temperature of the refrigerating compartment 112 and the temperature detected by the first evaporator sensor 43 is gradually reduced. Therefore, the output of the refrigerating compartment fan 29 may be reduced stepwise based on a difference value between the temperature detected by the first evaporator sensor 43 and the temperature detected by the refrigerating compartment temperature sensor 42, for example.

The refrigerating compartment fan 29 may be operated at a first initial output during operation of the refrigerating cycle.

When the difference value between the temperature detected by the first evaporator sensor 43 and the temperature detected by the refrigerating compartment temperature sensor 42 is determined to be smaller than a first reference difference value (i.e., when an output reduction condition is satisfied) while the refrigerating compartment fan 29 is operating at the first initial output, the refrigerating compartment fan 29 may then be operated at a first reduced output lower than the first initial output.

When the difference value between the temperature detected by the first evaporator sensor 43 and the temperature detected by the refrigerating compartment temperature sensor 42 is determined to be smaller than a second reference difference value (i.e., when a first additional reduction condition is satisfied) while the refrigerating compartment fan 29 is operating at the first reduced output, the refrigerating compartment fan 29 may then be operated at a second reduced output lower than the first reduced output. In this example, the second reference difference value may be smaller than the first reference difference value.

When the difference value between the temperature detected by the first evaporator sensor 43 and the temperature detected by the refrigerating compartment temperature sensor 42 is determined to be smaller than a third reference difference value (i.e., when a second additional reduction condition is satisfied) while the refrigerating compartment fan 29 is operating at the second reduced output, the refrigerating compartment fan 29 may then be stopped or be operated at a third reduced output lower than the second reduced output.

In this example, the third reference difference value may be smaller than the second reference difference value. When the refrigerating compartment fan 29 is operated at the third reduced output, the refrigerating compartment fan 29 may then be turned off after a set time has elapsed.

When the operating time of the refrigerating compartment fan 29 reaches a time limit, control for the refrigerating compartment fan 29 is terminated. That is, although the refrigerating compartment fan 29 is being operated at the first initial output, the first reduced output, or the second reduced output, when the operating time of the refrigerating compartment fan 29 reaches a time limit, the refrigerating compartment fan 29 may be turned off.

A relationship in magnitude among the first initial output, the first reference output, the first and the second reduced outputs is the same as described above with respect to the first example. Thus, a detailed description thereof may be omitted. In the third example, a difference value between the first reference difference value and the second reference difference value may be set to be equal to or larger than a difference value between the second reference difference value and the third reference difference value.

Fourth Example of Output Control for Refrigerating Compartment Fan In Freezing Cycle Operation During operation of the freezing cycle, the output of the refrigerating compartment fan 29 may be reduced stepwise based on the temperature of the refrigerating compartment detected by the refrigerating compartment temperature sensor 42.

As shown in FIG. 5, after the freezing cycle is started, the temperature of the refrigerating compartment 112 may decrease and then increase. Accordingly, the output of the refrigerating compartment fan 29 may be reduced stepwise based on a result of comparison between the temperature detected by the refrigerating compartment temperature sensor 42 and a set value.

The refrigerating compartment fan 29 may be operating at a first initial output during operation of the refrigerating cycle. When the temperature detected by the refrigerating compartment temperature sensor 42 is less than a first set value (i.e., when an output reduction condition is satisfied) while the refrigerating compartment fan 29 is operating at the first initial output, the refrigerating compartment fan 29 may then be operated at a first reduced output lower than the first initial output.

When the temperature detected by the refrigerating compartment temperature sensor 42 is less than a second set value (i.e., when a first additional reduction condition is satisfied) while the refrigerating compartment fan 29 is operating at the first reduced output, the refrigerating compartment fan 29 may then be operated at a second reduced output lower than the first reduced output. The second set value may be less than the first set value.

When the temperature detected by the refrigerating compartment temperature sensor 42 is less than a third set value (i.e., when a second additional reduction condition is satisfied) while the refrigerating compartment fan 29 is operating at the second reduced output, the refrigerating compartment fan 29 may then be stopped or be operated at a third reduced output lower than the second reduced output. The third set value is less than the second set value.

When the refrigerating compartment fan 29 is operated at the third reduced output, the refrigerating compartment fan 29 may then be turned off after a set time has elapsed.

When the operating time of the refrigerating compartment fan 29 reaches a time limit, control for the refrigerating compartment fan 29 is terminated. That is, although the refrigerating compartment fan 29 is being operated at the first initial output, the first reduced output, or the second reduced output, when the operating time of the refrigerating compartment fan 29 reaches a time limit, the refrigerating compartment fan 29 may be turned off.

A relationship in magnitude among the first initial output, the first reference output, the first and the second reduced outputs is the same as described above with respect to the first example. Thus, a detailed description thereof may be omitted.

In the fourth example, the difference value between the first set value and the second set value may be set to be equal to or larger than a difference value between the second set value and the third set value.

In the above-described embodiments, the refrigerating compartment fan 29 may be continuously operated at the minimum output (e.g., the third reduced output) until the stop condition of the second cooling cycle is satisfied without being stopped after the output of the refrigerating compartment fan 29 has been reduced stepwise. On the other hand, when the freezing cycle is operated, the temperature of the freezing compartment 111 may decrease, while the temperature of the refrigerating compartment 112 may increase.

The output of the compressor 21 when the freezing cycle is operated may be larger than the output of the compressor 21 when the first refrigerating cycle is operated. That is, in the first refrigerating cycle, the compressor 21 is driven at a first output, and when the freezing cycle is started, the compressor 21 may be driven at a second output larger than the first output.

The controller 50 may determine whether a stop condition of the freezing cycle is satisfied during the operation of the freezing cycle (S5). For example, when the temperature of the freezing compartment 111 is lower than or equal to a first refrigerating compartment reference temperature, the freezing cycle may be stopped.

When the freezing cycle is stopped, the second refrigerating cycle may be operated (S6). For example, the controller 50 may switch (or change) the switching valve 26 to a first state such that refrigerant flows to the refrigerating compartment evaporator 25. The controller 50 may stop the freezing compartment fan 28 and operate the refrigerating compartment fan 29.

However, even when switching (or change)from the freezing cycle to the second refrigerating cycle is performed, the compressor 21 may be continuously driven without being stopped. In this example, the output of the compressor 21 in the second refrigerating cycle may be smaller than the output of the compressor 21 in the freezing cycle. That is, in the freezing cycle, the compressor 21 may be driven at a second output, and when the freezing cycle is started, the compressor 21 may be driven at a third output smaller than the second output.

The first refrigerating cycle is to lower the temperature of the refrigerating compartment 112. The second refrigerating cycle is to delay rising of the temperature of the refrigerating compartment 112 before the pump down operation. Thus, the third output may be equal to or lower than the first output. However, the output of the compressor 21 may be maintained at or reduced to a third output during the operation of the second refrigerating cycle.

When the second refrigerating cycle is operated, the refrigerating compartment fan 29 may be operated at a second reference output. As an example, the second reference output may be equal to the first reference output. In the present embodiment, the second refrigerating cycle is operated to delay rising of the temperature of the refrigerating compartment 112. Therefore, in the second refrigerating cycle, the second reference output is equal to the first reference output so that the temperature of the refrigerating compartment 112 is rapidly lowered.

The second reference output may be maintained to be constant until the second refrigerating cycle is stopped. Alternatively, the second reference output may be decreased or increased one or more times until the second refrigerating cycle is stopped.

For example, the refrigerating compartment fan 29 is operated at the second reference output during the operation of the second refrigerating cycle, and when the temperature of the refrigerating compartment 112 is lower than or equal to a reduction reference value, the refrigerating compartment fan 29 is then operated at an output lower than the second reference output. The reduction reference value may be a set temperature of the refrigerating compartment, for example.

As another example, the output of the refrigerating compartment fan 29 during operation of the second refrigerating cycle may be determined based on the temperature of the refrigerating compartment 112.

When the temperature of the refrigerating compartment 112 is determined to be higher than the set temperature of the refrigerating compartment during operation of the second refrigerating cycle, the refrigerating compartment fan 29 may then be operated at the second reference output. In this example, the second reference output may be equal to or higher than the first reference output.

On the other hand, when the temperature of the refrigerating compartment 112 is determined to be lower than the set temperature of the refrigerating compartment during operation of the second refrigerating cycle, the refrigerating compartment fan 29 may then be operated at the third reference output smaller than the second reference output. The third reference output may be lower than the first reference output and may be the minimum output, for example.

Additionally, in an example in which the refrigerating compartment fan 29 is operated at the second reference output because the temperature of the refrigerating compartment 112 is higher than the set temperature of the refrigerating compartment, when the temperature of the refrigerating compartment 112 is lower than the set temperature of the refrigerating compartment, the refrigerating compartment fan 29 may then be operated at the third reference output.

As another example, when the temperature of the refrigerating compartment 112 is determined to be higher than a first reduced reference value during operation of the second refrigerating cycle, the refrigerating compartment fan 29 may then be operated at the second reference output (e.g., the maximum output).

The first reduced reference value may be larger than the set temperature of the refrigerating compartment 112. The second reference output may be an output equal to or larger than the first reference output.

On the other hand, when the temperature of the refrigerating compartment 112 is determined to be higher than the second reduced reference value during operation of the second refrigerating cycle, the refrigerating compartment fan 29 may then be operated at the third reference output (e.g., the intermediate output) lower than the second reference output. In this example, the second reduced reference value may be less than the set temperature of the refrigerating compartment 112 and larger than the first refrigerating compartment reference temperature. The third reference output may be an output smaller than the first reference output.

When the temperature of the refrigerating compartment 112 is determined to be lower than the second reduced reference value during operation of the second refrigerating cycle, the refrigerating compartment fan 29 may then be operated at a fourth reference output (e.g., the minimum output) lower than the third reference output. In this example, the fourth reference output may be an output larger than zero.

The controller 50 may determine whether a stop condition of the second refrigerating cycle is satisfied during the operation of the second refrigerating cycle (S7). For example, when the operating time of the second refrigerating cycle (or the operating time of the refrigerating compartment fan 29) reaches a stop reference time, the controller 50 may determine that the stop condition of the second refrigerating cycle is satisfied.

When the second refrigerating cycle is stopped, the pump down operation may be performed (S8). The output of the compressor 21 in the example of the pump down operation may be equal to the output of the compressor 21 in a example where the freezing cycle is operated.

The compressor 21 is maintained in an ON state during the pump down operation. The compressor 21 is turned off when the pump down operation is completed.

The switching valve 26 may be switched (or changed) to a third state such that the refrigerant is not supplied to the evaporators 24 and 25. In at least one non-limiting example, the refrigerating compartment valve and the freezing compartment valve may be turned off.

On the other hand, even when the pump down operation is started, the refrigerating compartment fan 29 may be continuously operated without being stopped.

In the present embodiment, the compressor 21 is stopped when the pump down operation is finished, but the refrigerating compartment fan 29 may be stopped after the compressor 21 may be stopped.

When the compressor 21 is stopped after the pump down operation is finished, the temperature of the refrigerating chamber 112 may rise. Therefore, in the present embodiment, the refrigerating compartment fan 29 may be operated to delay rising of the temperature of the refrigerating compartment 112 even after the compressor 21 is stopped.

Therefore, for ease of description, an operation interval of the second refrigerating cycle may be referred to as a first constant temperature interval, and an interval from the time point at which pump down operation is started to the time point at which the refrigerating compartment fan 29 is stopped may be referred to as a second constant temperature interval.

An interval from a start time point of the freezing cycle to the time point at which the refrigerating compartment fan 29 is stopped may be referred to as a power saving interval.

In the second constant temperature interval, the refrigerating compartment fan 29 may be operated at a second initial output, and may be reduced stepwise. For example, the second initial output may be equal to or lower than the second reference output in the first constant temperature interval.

First Example of Output Control of Refrigerating Compartment Fan in Second Constant Temperature Interval During the second constant temperature interval, the output of the refrigerating compartment fan 29 may be reduced stepwise as time elapses. For example, at the beginning of the second constant temperature interval, the refrigerating compartment fan 29 may be operated at the second initial output. When a fourth reference time T4 elapses while the refrigerating compartment fan 29 is operating at the second initial output, the refrigerating compartment fan 29 may then be operated at a fourth reduced output lower than the second initial output. When a fifth reference time T5 elapses while the refrigerating compartment fan 29 is operating at the fourth reduced output, the refrigerating compartment fan 29 may then be operated at a fifth reduced output lower than the fourth reduced output.

When a sixth reference time T6 elapses while the refrigerating compartment fan 29 is operating at the fifth reduced output, the refrigerating compartment fan 29 may then be stopped or operated at a sixth reduced output lower than the fifth reduced output.

In the second constant temperature interval, the output of the refrigerating compartment fan 29 may be reduced one or more times from the second initial output. For example, the second initial output may be equal to or less than the first initial output.

When the second initial output is lower than the first initial output, a difference value between the first initial output and the second initial output may be smaller than or equal to a difference value between the second initial output and the fourth reduced output. That is, an output reduction width from the second initial output to the fourth reduced output may be larger than or equal to an output reduction width from the first initial output to the second initial output.

Further, a difference value between the second initial output and the fourth reduced output may be smaller than or equal to a difference value between the fourth reduced output and the fifth reduced output. That is, an output reduction width from the fourth reduced output to the fifth reduced output may be larger than or equal to the output reduction width from the second initial output to the fourth reduced output.

During the second constant temperature interval, the output of the refrigerating compartment fan 29 may be reduced stepwise, and the output reduction width may be increased or remain constant.

The fifth reference time T5 may be shorter than or equal to the fourth reference time T4. The sixth reference time T6 may be shorter or equal to the fifth reference time T5.

During the second constant temperature interval, the output of the refrigerating compartment fan 29 may be reduced stepwise, and a length of the reference time for output reduction may be reduced stepwise or remain constant. For example, the second initial output may be set to be higher than the other reduced outputs, and the fourth reference time may be set to be longer than the remaining reference times.

In at least one non-limiting example, the average output (or average number of rotations) of the refrigerating compartment fan 29 during the second constant temperature interval may be less than the average output (or average number of rotations) of the refrigerating compartment fan 29 during the power saving interval.

In at least one non-limiting example, the length of the second constant temperature interval may be shorter than the length of the power saving interval (i.e., the operating time of the refrigerating compartment fan during the power saving interval).

In at least one non-limiting example, the average of reference times during the second constant temperature interval may be set to be smaller than the average of reference times during the power saving interval.

In at least one non-limiting example, the length of a reference time having the maximum value among the plurality of reference times may be shorter than in the power saving interval and may be set to be shorter than the length of a reference time having the maximum value among the plurality of reference times during the second constant temperature interval.

Second Example of Output Control of Refrigerating Compartment Fan in Second Constant Temperature Interval As a second example, during the second constant temperature interval, the output of the refrigerating compartment fan 29 may be reduced stepwise based on the temperature detected by the first evaporator sensor 43. For example, the refrigerating compartment fan 29 may be operated at a second initial output during operation of the freezing cycle.

When the temperature detected by the first evaporator sensor 43 is determined to be higher than a fourth reference temperature value while the refrigerating compartment fan 29 is operating at the second initial output, the refrigerating compartment fan 29 may then be operated at a fourth reduced output lower than the second initial output.

When the temperature detected by the first evaporator sensor 43 is determined to be higher than a fifth reference temperature value higher than the fourth reference temperature value while the refrigerating compartment fan 29 is operating at the fourth reduced output, the refrigerating compartment fan 29 may then be operated at a fifth reduced output lower than the fourth reduced output.

When the temperature detected by the first evaporator sensor 43 is determined to be higher than a sixth reference temperature value higher than the fifth reference temperature value while the refrigerating compartment fan 29 is operating at the fifth reduced output, the refrigerating compartment fan 29 may then be stopped or be operated at a sixth reduced output lower than the second reduced output.

When the refrigerating compartment fan 29 is operated at the sixth reduced output, the refrigerating compartment fan 29 may then be turned off after a set time has elapsed.

A relationship in magnitude among the first initial output, the second initial output, and the fourth reduced output to the sixth reduced output is the same as described with respect to the first example. Thus, the detailed description thereof may be omitted.

According to the present embodiment, a difference value between the fourth reference temperature value and the fifth reference temperature value may be set to be equal to or larger than a difference value between the fifth reference temperature value and the sixth reference temperature value.

The maximum value (for example, the third reference temperature value) among the reference temperature values in the power saving interval may be equal to or larger than the minimum value (for example, the fourth reference temperature value) among the reference temperature values in the second constant temperature interval. Alternatively, the minimum value (for example, the fourth reference temperature value) of the reference temperature value in the second constant temperature interval may be larger than the minimum value (for example, the first reference temperature value) of the reference temperature values in the power saving interval.

Third Example of Output Control of Refrigerating Compartment Fan in Second Constant Temperature Interval During the second constant temperature interval, the output of the refrigerating compartment fan 29 may be reduced stepwise based on the temperature detected by the first evaporator sensor 43 and the temperature of the refrigerating compartment detected by the refrigerating compartment temperature sensor 42. The output of the refrigerating compartment fan 29 may be reduced stepwise based on a difference value between the temperature detected by the first evaporator sensor 43 and the temperature detected by the refrigerating compartment temperature sensor 42, for example.

The refrigerating compartment fan 29 may be operated at a second initial output during operation of the refrigerating cycle.

When the difference value between the temperature detected by the first evaporator sensor 43 and the temperature detected by the refrigerating compartment temperature sensor 42 is determined to be smaller than a fourth reference difference value while the refrigerating compartment fan 29 is operated at the second initial output, the refrigerating compartment fan 29 may then be operated at a fourth reduced output lower than the second initial output.

When the difference value between the temperature detected by the first evaporator sensor 43 and the temperature detected by the refrigerating compartment temperature sensor 42 is determined to be smaller than a fifth reference difference value while the refrigerating compartment fan 29 is operating at the fourth reduced output, the refrigerating compartment fan 29 may then be operated at a fifth reduced output lower than the fourth reduced output. The fifth reference difference value may be less than the fourth reference difference value.

When the difference value between the temperature detected by the first evaporator sensor 43 and the temperature detected by the refrigerating compartment temperature sensor 42 is determined to be smaller than a sixth reference difference value while the refrigerating compartment fan 29 is operating at the fifth reduced output, the refrigerating compartment fan 29 may then be stopped or operated at a sixth reduced output lower than the fifth reduced output. The sixth reference difference value may be less than the fifth reference difference value. When the refrigerating compartment fan 29 is operated at the sixth reduced output, the refrigerating compartment fan 29 may then be turned off after a set time has elapsed.

When the operating time of the refrigerating compartment fan 29 reaches a time limit during the second constant temperature interval, the control of the refrigerating compartment fan 29 is terminated. That is, although the refrigerating compartment fan 29 is being operated at the second initial output, the fourth reduced output, or the fifth reduced output, when the operating time of the refrigerating compartment fan 29 reaches a time limit, the refrigerating compartment fan 29 may be turned off.

A relationship in magnitude among the first initial output, the second initial output, and the fourth reduced output to the sixth reduced output is the same as described with respect to the first example. Thus, a detailed description thereof may be omitted.

A difference value between the fourth reference difference value and the fifth reference difference value may be set to be equal to or larger than a difference value between the fifth reference difference value and the sixth reference difference value.

The maximum value (for example, the first reference difference value) among the reference difference values in the power saving interval may be larger than the maximum value (for example, the fourth reference difference value) among the reference difference values in the second constant temperature interval. In at least one embodiment, at least one value of the reference difference values in the power saving interval may be equal to at least one value of the reference difference values in the second constant temperature interval.

Fourth Example of Output Control of Refrigerating Compartment Fan in Second Constant Temperature Interval During the second constant temperature interval, the output of the refrigerating compartment fan 29 may be reduced stepwise based on the temperature of the refrigerating compartment detected by the refrigerating compartment temperature sensor 42.

The refrigerating compartment fan 29 may be operated at a second initial output during operation of the refrigerating cycle.

When the temperature detected by the refrigerating compartment temperature sensor 42 is determined to be less than a fourth set value while the refrigerating compartment fan 29 is operating at the second initial output, the refrigerating compartment fan 29 may then be operated at a fourth reduced output lower than the second initial output.

When the temperature detected by the refrigerating compartment temperature sensor 42 is determined to be less than a fifth set value while the refrigerating compartment fan 29 is operating at the fourth reduced output, the refrigerating compartment fan 29 may then be operated at a fifth reduced output lower than the fourth reduced output. The fifth set value is less than the fourth set value.

When the temperature detected by the refrigerating compartment temperature sensor 42 is determined to be less than a sixth set value while the refrigerating compartment fan 29 is operating at the fifth reduced output, the refrigerating compartment fan 29 may then be stopped or operated at a sixth reduced output lower than the fifth reduced output. The sixth set value is less than the fifth set value. When the refrigerating compartment fan 29 is operated at the sixth reduced output, the refrigerating compartment fan 29 may then be turned off after a set time has elapsed.

When the operating time of the refrigerating compartment fan 29 reaches a time limit during the second constant temperature interval, the control for the refrigerating compartment fan 29 is terminated. That is, although the refrigerating compartment fan 29 is being operated at the second initial output, the second reduced output, or the fifth reduced output, when the operating time of the refrigerating compartment fan 29 reaches a time limit, the refrigerating compartment fan 29 may be turned off.

A relationship in magnitude among the first initial output, the second initial output, and the fourth reduced output to the sixth reduced output is the same as described with respect to the first example. Thus, a detailed description thereof may be omitted.

The difference value between the fourth set value and the fifth set value may be set to be equal to or larger than a difference value between the fifth set value and the sixth set value.

The minimum value (for example, the third set value) among the set values in the power saving interval may be less than the minimum value (for example, the fourth reference temperature value) among the set values in the second constant temperature interval. In at least one non-limiting example, at least one value of the reference difference values in the power saving interval may be equal to at least one value of the reference difference values during the second constant temperature interval.

In at least one non-limiting example, in a state in which the pump down operation is completed, the compressor 21 is stopped, the second constant temperature interval is terminated, and the refrigerating compartment fan 29 is stopped, as long as the power source of the refrigerator 1 is turned off (S7), the controller 50 may then again operate the first refrigerating cycle when a start condition of the first refrigerating cycle is satisfied. The pump down operation may be performed a predetermined time.

Although it has been described above that the freezing compartment fan 28 is stopped immediately after the freezing cycle is stopped, the freezing compartment fan 28 may be operated continuously to delay rising of the temperature of the freezing compartment after the freezing cycle is stopped. The output of the freezing compartment fan 28 may be reduced stepwise. That is, the freezing compartment fan 28 may be controlled according to the same method as a method of controlling the output of the refrigerating compartment fan 29 discussed in the power saving interval. The refrigerating compartment fan 29 may be operated after the freezing compartment fan 28 is stopped.

When the temperature detected by the first evaporator sensor 43 is determined to be higher than a fourth reference temperature value while the refrigerating compartment fan 29 is operating at the second initial output, the refrigerating compartment fan 29 may be operated at a fourth reduced output lower than the second initial output.

When the temperature detected by the first evaporator sensor 43 is determined to be higher than a fifth reference temperature value higher than the fourth reference temperature value while the refrigerating compartment fan 29 is operating at the fourth reduced output, the refrigerating compartment fan 29 may then be operated at a fifth reduced output lower than the fourth reduced output.

When the temperature detected by the first evaporator sensor 43 is determined to be higher than a sixth reference temperature value higher than the fifth reference temperature value while the refrigerating compartment fan 29 is operating at the fifth reduced output, the refrigerating compartment fan 29 may then be stopped or operated at a sixth reduced output lower than the second reduced output.

When the refrigerating compartment fan 29 is operated at the sixth reduced output, the refrigerating compartment fan 29 may then be turned off after a set time has elapsed.

The compressor may not be stopped when the pump down is performed after the second refrigeration cycle is stopped, and the first refrigeration cycle may be immediately performed. The compressor 21 may be driven continuously without being stopped unless the power is turned off. Even in this example, the output control of the refrigerator compartment fan 29 described above may be applied as it is.

However, in the first operation period, the compressor 21 in a an example in which the first refrigerating cycle is operated is operated at a first cooling force (or output), and when the first refrigerating cycle of a second operation period is operated after completion of the pump down operation in the first operation period, the compressor 21 may be driven at a second cooling force which is a cooling fourth identical to or changed from the first cooling force.

The second cooling force of the compressor may be determined based on a change in the temperature of the refrigerating chamber 112 in the first operation period.

In the first operation period, the compressor 21 in a case in which the freezing cycle is operated is operated at a third cold force, and when the freezing cycle of the second operation period is operated, the compressor 21 is driven at a fourth cooling force which is a cooling fourth identical to or changed from the first cooling force. The fourth cooling force of the compressor may be determined based on a change in temperature of the freezing chamber 111 in the second operation period.

Embodiments may provide a refrigerator and a method of controlling the same, capable of reducing power consumption by operating a first cooling fan, which is being operated in a first cooling cycle, without stopping the first cooling fan and reducing the output of the first cooling fan, in a stepwise manner, after a first cooling cycle is stopped.

Embodiments may provide a refrigerator and a control method thereof, capable of reducing power consumption by adjusting the output of the first cooling fan in a third cooling cycle after a second cooling cycle is stopped.

According to an aspect, a method of controlling a refrigerator includes operating a first cooling cycle for a first storage compartment to drive a compressor and operating a first cooling fan for cooling the first storage compartment, switching to a second cooling cycle for cooling a second storage compartment to drive the compressor and operating a second cooling fan for cooling the second storage compartment when a stop condition of the first cooling cycle is satisfied, and switching to a third cooling cycle for cooling the first storage compartment to drive the compressor and operating the first cooling fan when a stop condition of the second cooling cycle is satisfied.

The first cooling fan may be continuously operated when switching from the first cooling cycle to the second cooling cycle is performed.

An output of the first cooling fan may be controlled to be decreased based on an elapse of time or a temperature change of at least one of a temperature of the first storage compartment and a temperature of a first evaporator for supplying cold air to the first storage compartment, during operation of the second cooling cycle.

The output of the first cooling fan may be reduced stepwise during operation of the second cooling cycle.

The first cooling fan may be operated at a first initial output during the operation of the second cooling cycle. The first cooling fan may be operated at a first reduced output lower than the first initial output when an output reduction condition of the first cooling fan is satisfied.

The first cooling fan may be operated at a second reduced output lower than the first reduced output when an additional reduction condition of the first cooling fan is satisfied in a process of operating the first cooling fan at the first reduced output.

When a second additional reduction condition is satisfied while the first cooling fan is operated at the second reduced output, the first cooling fan is stopped, the first cooling fan is stopped when a set time elapses after the first cooling fan is operated at a third reduced output lower than the second reduced output, or the first cooling fan is continuously operated at the third reduced output until the stop condition of the second cooling cycle is satisfied.

The case where the output reduction condition is satisfied is a case where a first reference time elapses at a time point at which the first cooling fan starts to be operated at the first initial output may be a case where the temperature of the first evaporator is higher than a first reference temperature value, a case where a difference value between the temperature of the first evaporator and the temperature of the first storage compartment is lower than a first reference difference value, or a case where the temperature of the first storage compartment is lower than a first set value.

The case where the first additional condition is satisfied may be a case where a second reference time elapses at a time point at which the first cooling fan starts to be operated at the first reduced output, a case where the temperature of the first evaporator is higher than a second reference temperature value which is higher than the first reference temperature value, a case where a difference value between the temperature of the first evaporator and the temperature of the first storage compartment is lower than a second reference difference value, or a case where the temperature of the second storage compartment is lower than a second set value. The second reference difference value may be smaller than the first reference difference value, and the second set value may be smaller than the first set value.

The first cooling fan may be operated at a first reference output during the first cooling cycle, and the first initial output may be smaller than or equal to the first reference output.

A first difference value between the first reference output and the first initial output may be smaller than or equal to a second difference value between the first initial output and the first reduced output.

The second difference value between the first initial output and the first reduced output may be smaller than or equal to a third difference value between the first reduced output and the second reduced output.

The first cooling fan may be operated at a second reference output during the third cooling cycle, and the second reference output may be maintained consistently or reduced one time or more during operation of the third cooling cycle.

The second reference output may be equal to the first reference output.

The first cooling fan may be operated at the second reference output during operation of the third cooling cycle. The first cooling fan may be operated at an output lower than the second reference output when a temperature of the first refrigerating compartment is lower than or equal to a reduced reference value.

The first cooling fan may be operated at the second reference output during operation of the third cooling cycle when the temperature of the first storage compartment is higher than a set temperature of the first storage compartment.

The first cooling fan may be operated at a third reference output smaller than the second reference output when a temperature of the first storage compartment is lower than a set temperature of the first storage compartment.

The first cooling fan may be operated at the second reference output during operation of the third cooling cycle when the temperature of the first storage compartment is higher than a first reduced reference value.

The first cooling fan may be operated at a third reference output lower than the second reference output when the temperature of the first storage compartment is higher than a second reduced reference value.

The first cooling fan may be operated at a fourth reference output lower than the third reference output when the temperature of the first storage compartment is lower than a second reduced reference value. The first reduced reference value may be larger than a set temperature of the first storage compartment, and the second reduced reference value may be smaller than a set temperature of the first storage compartment.

The method may further performing a pump down operation include when a stop condition of the third cooling cycle is satisfied.

The first cooling fan may be operated at a second initial output during the pump down operation and the output of the first cooling fan may be reduced one time or more until the first cooling fan is stopped.

During the pump down operation, the output of the first cooling fan may be reduced as time elapses during the pump down operation, the output of the first cooling fan may be reduced when the temperature of the first storage compartment is lower than a set value, the output of the first cooling fan may be reduced when a difference value between the temperature of the first evaporator and the temperature of the first storage compartment is lower than a reference difference value, or the output of the first cooling fan may be reduced when the temperature of the first evaporator is higher than a reference temperature value.

An average power of the first cooling fan after the pump down operation is started may be larger than an average power of the first cooling fan during the second cooling cycle, or an operating time of the first cooling fan after the pump down operation is started may be larger than an operating time of the first cooling fan during the second cooling cycle.

According to another aspect, a refrigerator may include a compressor configured to compress refrigerant, a first evaporator configured to receive refrigerant from the compressor to generate cold air for cooling a first storage compartment, a first cooling fan configured to supply cold air to the first storage compartment, a second evaporator to receive refrigerant from the compressor to generate cold air for cooling a second storage compartment, a second cooling fan configured to supply cold air to the second storage compartment, a valve configured to selectively open one of a first refrigerant passage connecting the compressor and the first evaporator to allow the refrigerant to flow and a second refrigerant passage connecting the compressor and the second evaporator to allow the refrigerant to flow, and a controller configured to control the first cooling fan, the second cooling fan and the valve.

The controller may drive the compressor and the first cooling fan to cool the first storage compartment, and drive the compressor and the second cooling fan to cool the second storage compartment when cooling of the first storage compartment is completed. The first cooling fan may be operated during cooling of the second storage compartment, and an output of the first cooling fan may be reduced based on an elapse of time or a temperature change in at least one of a temperature of the first storage compartment and a temperature of the first evaporator for supplying cold air to the first storage compartment.

According to another aspect, a method of controlling a refrigerator, includes operating a first cooling cycle for a first storage compartment to drive a compressor and operating a first cooling fan for cooling the first storage compartment, switching to a second cooling cycle for cooling a second storage compartment to drive the compressor and operating a second cooling fan for cooling the second storage compartment when a stop condition of the first cooling cycle is satisfied, switching to a third cooling cycle for cooling the first storage compartment to drive the compressor and operating the first cooling fan when a stop condition of the second cooling cycle is satisfied, and performing a pump down operation when a stop condition of the third cooling cycle.

The first cooling fan may be continuously operated when switching from the first cooling cycle to the second cooling cycle is performed, and an output of the first cooling fan may be reduced based on an elapse of time during operation of the second cooling cycle. The output of the first cooling fan may be reduced stepwise according to the elapse of time during operation of the second cooling cycle.

The first cooling fan may be operated at a first initial output during operation of the second cooling cycle, and when the first reference time elapses, be operated at a first reduced output lower than the first initial output.

The first cooling fan may be operated at a second reduced output lower than the first reduced output when a second reference time elapses in a process of operating the first cooling fan at the first reduced output.

When a third reference time has elapsed while the first cooling fan is operated at the second reduced output, the first cooling fan is stopped, the first cooling fan is stopped when a set time elapses after the first cooling fan is operated at a third reduced output lower than the second reduced output, or the first cooling fan is continuously operated at the third reduced output until the stop condition of the second cooling cycle is satisfied.

The first cooling fan may be operated at a first reference output during the first cooling cycle, and the first initial output may be equal to the first reference output.

Furthermore, the first cooling fan may be operated at a first reference output during the first cooling cycle, and the first initial output may be smaller than the first reference output.

A first difference value between the first reference output and the first initial output may be smaller than or equal to a second difference value between the first initial output and the first reduced output.

The second difference value between the first initial output and the first reduced output may be smaller than or equal to a third difference value between the first reduced output and the second reduced output. The second reference time may be shorter than or equal to the first reference time. The third reference time may be shorter than or equal to the second reference time.

The first cooling fan may be operated at a second reference output during the third cooling cycle, and the second reference output may be maintained consistently or reduced one time or more during operation of the third cooling cycle.

The second reference output may be equal to the first reference output.

The first cooling fan may be operated at the second reference output during the operation of the third cooling cycle, and the first cooling fan may be operated at an output lower than second reference output when the temperature of the first storage compartment is lower than or equal to a reduced reference value.

The first cooling fan may be operated at the second reference output when the temperature of the first storage compartment is higher than a set temperature of the first storage compartment during the operation of the third cooling cycle, and the first cooling fan may be operated at a third reference output lower than second reference output when the temperature of the first storage compartment is lower than the set temperature of the first storage compartment.

The first cooling fan may be operated at the second reference output when the temperature of the first storage compartment is higher than a first reduced reference value during the operation of the third cooling cycle. The first cooling fan may be operated at the third reference output lower than the second reference output when the temperature of the first storage compartment is higher than a second reduced reference value, and the first cooling fan may be operated at a fourth reference output lower than third reference output when the temperature of the first storage compartment is lower than a second reduced reference value. The first reduced reference value may be larger than a set temperature of the first storage compartment, and the second reduced reference value may be lower than a set temperature of the first storage compartment.

The first cooling fan may be operated at a second initial output during the pump down operation and the output of the first cooling fan may be reduced as time elapses.

The first cooling fan may be operated at a fourth reduced output lower than the second initial output when a fourth reference time elapses in a process of operating the first cooling fan at the second reduced output.

The first cooling fan may be operated at a fifth reduced output lower than the fourth reduced output when a fifth reference time elapses in a process of operating the first cooling fan at the fourth reduced output.

The first cooling fan may be stopped when a sixth reference time has elapsed in a process of operating the first cooling fan at the fifth reduced output or stopped after the first cooling fan is operated at a sixth reduced output lower than the fifth reduced output and a set time elapses.

The fifth reference time may be shorter than or equal to the fourth reference time. The sixth reference time may be shorter than or equal to the fifth reference time.

A time during which the first cooling fan is operated after the pump down operation is started may be shorter than a time during which the first cooling fan is operated in the second cooling cycle.

An average of the fourth reference time to the sixth reference time may be smaller than an average of the first reference time to the third reference time.

The length of the first reference time may be longer than the length of the fourth reference time.

According to another aspect, a method of controlling a refrigerator, includes operating a first cooling cycle for a first storage compartment to drive a compressor and operating a first cooling fan for cooling the first storage compartment, switching to a second cooling cycle for cooling a second storage compartment to drive the compressor and operating a second cooling fan for cooling the second storage compartment when a stop condition of the first cooling cycle is satisfied, performing a pump down operation when a stop condition of the second cooling cycle, and operating the first cooling cycle again after the pump down operation.

The first cooling fan may be continuously operated when switching from the first cooling cycle to the second cooling cycle is performed, and an operating time of the first cooling fan may be reduced as time elapses during the second cooling cycle.

The first cooling cycle, the second cooling cycle, and the pump down operation may constitute a single operation period, and in the first operation period, the compressor may be driven at a first cooling force when the first cooling cycle is operated. When the first cooling cycle of the second operation period is operated, the compressor may be driven at a second cooling force which is a cooling force equal to or changed from the first cooling force. The second cooling force of the compressor may be determined based on a change in the temperature of the first storage compartment in the first operation period.

According to another aspect, a refrigerator may include a compressor configured to compress refrigerant, a first evaporator configured to receive refrigerant from the compressor to generate cold air for cooling a first storage compartment, a first cooling fan configured to supply cold air to the first storage compartment, a second evaporator to receive refrigerant from the compressor to generate cold air for cooling a second storage compartment, a second cooling fan configured to supply cold air to the second storage compartment, a valve configured to selectively open one of a first refrigerant passage connecting the compressor and the first evaporator to allow the refrigerant to flow and a second refrigerant passage connecting the compressor and the second evaporator to allow the refrigerant to flow, and a controller configured to control the first cooling fan, the second cooling fan and the valve.

The controller may drive the compressor and the first cooling fan to cool the first storage compartment and drive the compressor and the second cooling fan to cool the second storage compartment when cooling of the first storage compartment is completed.

The first cooling fan may be operated in the process of cooling of the second storage compartment and the output of the first cooling fan may be reduced as time elapses.

According to a method of controlling a refrigerator according to another aspect, when switching from the first cooling cycle to the second cooling cycle is performed, the first cooling fan may be continuously operated and the output of the first cooling fan may be controlled to be decreased based on an elapse of time or a temperature change of at least one of a temperature of the first storage compartment and a temperature of a first evaporator for supplying cold air to the first storage compartment, during operation of the second cooling cycle.

The output of the first cooling fan may be reduced stepwise during operation of the second cooling cycle.

The first cooling fan may be operated at a first initial output during operation of the second cooling cycle, and when the temperature of the first evaporator is higher than a first reference temperature value, be operated at a first reduced output lower than the first initial output.

When the temperature of the first evaporator is higher than a second reference temperature value higher than the first reference temperature value while the first cooling fan is operated at the first reduced output, the first cooling fan may be operated at a second reduced output lower than the first reduced output.

When the temperature of the first evaporator is higher than a third reference temperature value larger than the second reference temperature value while the first cooling fan is operated at the second reduced output, the first cooling fan is stopped, the first cooling fan is stopped when a set time elapses after the first cooling fan is operated at a third reduced output lower than the second reduced output, or the first cooling fan is continuously operated at the third reduced output until the stop condition of the second cooling cycle is satisfied.

The first cooling fan may be operated at a second initial output during the pump down operation and the output of the first cooling fan may be reduced one time or more until the first cooling fan is stopped.

When the temperature of the first evaporator is higher than a fourth reference temperature value while the first cooling fan is operated at the second initial output, the first cooling fan may be operated at a fourth reduced output lower than the second reduced output.

When the temperature of the first evaporator is higher than a fifth reference temperature value higher than the fourth reference temperature value while the first cooling fan is operated at the fourth reduced output, the first cooling fan may be operated at a fifth reduced output lower than the fourth reduced output.

When the temperature of the first evaporator is higher than a sixth reference temperature value higher than the fifth reference temperature value while the first cooling fan is operated at the fifth reduced output, the first cooling fan may be stopped or, when a set time has elapsed after the first cooling fan is operated at the sixth reduced output lower than the fifth reduced output, may be stopped.

The third reference temperature value may be equal to or larger than the fourth reference temperature value. Alternatively, the fourth reference temperature value may be larger than the first reference temperature value.

A difference value between the first reference temperature value and the second reference temperature value may be equal to or larger than a difference value between the second reference temperature value and the third reference temperature value.

The first cooling fan may be operated at a first initial output during operation of the second cooling cycle, and when a difference value between the temperature of the first evaporator and the temperature of the first storage compartment is smaller than a first reference difference value, the first cooling fan may be operated at a first reduced output lower than the first initial output.

When a difference value between the temperature of the first evaporator and the temperature of the first storage compartment is smaller than a second reference difference value while the first cooling fan is operated at the first reduced output, the first cooling fan may be operated at a second reduced output lower than the first reduced output. The second reference difference value may be smaller than the first reference difference value.

When the difference value between the temperature of the first evaporator and the temperature of the first storage compartment is smaller than a third reference difference value while the first cooling fan is operated at the second reduced output, the first cooling fan may be stopped or, when a set time has elapsed after the first cooling fan is operated at the third reduced output lower than the second reduced output, may be stopped. The third reference difference value may be smaller than the second reference difference value.

When a difference value between the temperature of the first evaporator and the temperature of the first storage compartment is smaller than a fourth reference difference value while the first cooling fan is operated at the second initial output, the first cooling fan may be operated at a fourth reduced output lower than the second initial output.

When a difference value between the temperature of the first evaporator and the temperature of the first storage compartment is smaller than a fifth reference difference value smaller than the fourth reference difference value while the first cooling fan is operated at the fourth reduced output, the first cooling fan may be operated at a fifth reduced output lower than the fourth reduced output.

When the difference value between the temperature of the first evaporator and the temperature of the first storage compartment is smaller than a sixth reference difference value smaller than the fifth reference difference value while the first cooling fan is operated at the fifth reduced output, the first cooling fan may be stopped or, when a set time has elapsed after the first cooling fan is operated at the third reduced output lower than the second reduced output, may be stopped.

The first reference difference value may be larger than the fourth reference difference value. Alternatively, at least one of the first reference difference value and the second reference difference value may be equal to at least one of the fourth reference difference value to the sixth reference difference value.

A difference value between the first reference difference value and the second reference difference value may be equal to or larger than a difference value between the second reference difference value and the third reference difference value.

The first cooling fan may be operated at a first initial output during operation of the second cooling cycle, and when the temperature of the first storage compartment is lower than a first set value, be operated at a first reduced output lower than the first initial output.

When the temperature of the first storage compartment is lower than a second set value while the first cooling fan is operated at the first reduced output, the first cooling fan may be operated at a second reduced output lower than the first reduced output. The second set value may be smaller than the first set value.

When the temperature of the first storage compartment is lower than a third set value, the first cooling fan may be stopped or, when a set time has elapsed after the first cooling fan is operated at the third reduced output lower than the second reduced output, may be stopped. The third set value may be smaller than the second set value.

During the pump down operation, when the temperature of the first storage compartment is lower than a fourth set value while the first cooling fan is operated at the second initial output, the first cooling fan may be operated at a fourth reduced output lower than the second reduced output.

When the temperature of the first storage compartment is lower than a fifth set value smaller than the fourth set value while the first cooling fan is operated at the fourth reduced output, the first cooling fan may be operated at a fifth reduced output lower than the fourth reduced output.

When the temperature of the first storage compartment is lower than a sixth set value smaller than the fifth set value while the first cooling fan is operated at the fifth reduced output, the first cooling fan may be stopped or, when a set time has elapsed after the first cooling fan is operated at the sixth reduced output lower than the fifth reduced output, may be stopped.

A difference value between the first set value and the second set value may be equal to or larger than a difference value between the second set value and the third set value.

An average power of the first cooling fan after the pump down operation is started may be larger than an average power of the first cooling fan during the second cooling cycle. An operating time of the first cooling fan after the pump down operation is started may be larger than an operating time of the first cooling fan in the second cooling cycle.

When the operating time of the first cooling fan reaches a time limit while the first cooling fan is operated at the first initial output, the first reduced output or the second reduced output, the first cooling fan may be turned off.

The first cooling fan may be operated at a first reference output during the first cooling cycle, and the first initial output may be smaller than or equal to the first reference output.

The first cooling fan may be operated at a second reference output during the third cooling cycle, and the second reference output may be maintained consistently or reduced one time or more during operation of the third cooling cycle.

The first cooling fan may be operated at the second reference output during the operation of the third cooling cycle, and the first cooling fan may be operated at an output lower than second reference output when the temperature of the first storage compartment is lower than or equal to a reduced reference value.

Alternatively, the first cooling fan may be operated at the second reference output during operation of the third cooling cycle when the temperature of the first storage compartment is higher than a set temperature of the first storage compartment. Furthermore, the first cooling fan may be operated at a third reference output smaller than the second reference output when a temperature of the first storage compartment is lower than a set temperature of the first storage compartment.

The first cooling fan may be operated at the second reference output when the temperature of the first storage compartment is higher than a first reduced reference value during the operation of the third cooling cycle. Furthermore, the first cooling fan may be operated at a third reference output lower than the second reference output when the temperature of the first storage compartment is higher than a second reduced reference value. Furthermore, the first cooling fan may be operated at a fourth reference output lower than the third reference output when the temperature of the first storage compartment is lower than a second reduced reference value.

The first reduced reference value may be larger than a set temperature of the first storage compartment, and the second reduced reference value may be lower than a set temperature of the first storage compartment.

According to another aspect, a method of controlling a refrigerator, includes operating a first cooling cycle for a first storage compartment to drive a compressor and operating a first cooling fan for cooling the first storage compartment, switching to a second cooling cycle for cooling a second storage compartment to drive the compressor and operating a second cooling fan for cooling the second storage compartment when a stop condition of the first cooling cycle is satisfied, performing a pump down operation when a stop condition of the second cooling cycle, and operating the first cooling cycle again after the pump down operation.

When switching from the first cooling cycle to the second cooling cycle is performed, the first cooling fan may be continuously operated and the output of the first cooling fan may be controlled to be decreased based on an elapse of time or a temperature change of at least one of a temperature of the first storage compartment and a temperature of a first evaporator for supplying cold air to the first storage compartment, during operation of the second cooling cycle.

According to another aspect, a refrigerator may include a compressor configured to compress refrigerant, a first evaporator configured to receive refrigerant from the compressor to generate cold air for cooling a first storage compartment, a first cooling fan configured to supply cold air to the first storage compartment, a second evaporator to receive refrigerant from the compressor to generate cold air for cooling a second storage compartment, a second cooling fan configured to supply cold air to the second storage compartment, a valve configured to selectively open one of a first refrigerant passage connecting the compressor and the first evaporator to allow the refrigerant to flow and a second refrigerant passage connecting the compressor and the second evaporator to allow the refrigerant to flow, and a controller configured to control the first cooling fan, the second cooling fan and the valve.

The controller may drive the compressor and the first cooling fan to cool the first storage compartment and drive the compressor and the second cooling fan to cool the second storage compartment when cooling of the first storage compartment s completed.

The controller may operate the first cooling fan during the cooling of the second storage compartment and perform control such that the output of the first cooling fan is reduced based on a change in temperature of at least one of the temperature of the first storage compartment and the temperature of the first evaporator for supplying cool air to the first storage compartment.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a refrigerator, comprising:

operating a first cooling cycle for a first storage compartment, the first cooling cycle including driving a compressor and controlling a first cooling fan of the first storage compartment;

in response to a stop condition of the first cooling cycle, changing from the first cooling cycle to a second cooling cycle for a second storage compartment, and operating the second cooling cycle including driving the compressor and controlling a second cooling fan of the second storage compartment; and in response to a stop condition of the second cooling cycle, changing from the second cooling cycle to a third cooling cycle for the first storage compartment, and operating the third cooling cycle including driving the compressor and controlling the first cooling fan, wherein when changing from the first cooling cycle to the second cooling cycle, the first cooling fan is continuously operated, and wherein during the operating of the second cooling cycle, power for the first cooling fan is reduced based on an elapse of time or a temperature change in at least one of a temperature of the first storage compartment and a temperature of a first evaporator for supplying cold air to the first storage compartment.

2. The method of claim 1, wherein during the operating of the second cooling cycle, power to the first cooling fan is reduced a plurality of times in a stepwise manner, or wherein during the operating of the second cooling cycle, power to the first cooling fan is controlled to be a first initial output, and wherein in response to an output reduction condition, power to the first cooling fan is controlled to be a first reduced output lower than the first initial output.

3. The method of claim 2, wherein in response to a first addition reduction condition, power to the first cooling fan is controlled to be a second reduced output lower than the first reduced output.

4. The method of claim 3, wherein in response to a second additional reduction condition while operating the first cooling fan based the power being at the second reduced output, one of the following is performed:

power to the first cooling fan is stopped, power to the first cooling fan is controlled to be a third reduced output lower than the second reduced output and to stop when a set time elapses, and power to the first cooling fan is controlled to be the third reduced output until the stop condition of the second cooling cycle.

5. The method of claim 4, wherein the output reduction condition occurs based on one of the following:

when a first reference time elapses at a time point at which power to the first cooling fan starts to be operated at the first initial output, when the temperature of the first evaporator is determined to be higher than a first reference temperature value, when a difference value between the temperature of the first evaporator and the temperature of the first storage compartment is determined to be less than a first reference difference value, and when the temperature of the first storage compartment is determined to be less than a first set value.

6. The method of claim 5, wherein the first additional condition occurs based on one of the following:

when a second reference time elapses at a time point at which power to the first cooling fan starts to be at the first reduced output, when the temperature of the first evaporator is determined to be higher than a second reference temperature value which is higher than the first reference temperature value, when a difference value between the temperature of the first evaporator and the temperature of the first storage compartment is determined to be less than a second reference difference value, and when the temperature of the second storage compartment is determined to be less than a second set value, wherein the second reference difference value is smaller than the first reference difference value, or wherein the second set value is less than the first set value.

7. The method of claim 2, wherein during the operating of the first cooling cycle, power to the first cooling fan is controlled to be a first reference output, and wherein the first initial output is less than or equal to the first reference output.

8. The method of claim 7, wherein a first difference value between the first reference output and the first initial output is less than or equal to a second difference value between the first initial output and the first reduced output.

9. The method of claim 3, wherein the second difference value between the first initial output and the first reduced output is less than or equal to a third difference value between the first reduced output and the second reduced output.

10. The method of claim 7, wherein during the operating of the third cooling cycle, power to the first cooling fan is controlled to be a second reference output, and wherein during the operating of third cooling cycle, power to the second reference output is maintained consistently or is reduced one time or more.

11. The method of claim 10, wherein the second reference output is equal to the first reference output.

12. The method of claim 10, wherein during the operating of the third cooling cycle, power to the first cooling fan is controlled to be the second reference output, and wherein the power to first cooling fan is controlled to be an output lower than second reference output when the temperature of the first storage compartment is determined to be less than a reduced reference value.

13. The method of claim 10, wherein during the operating of the third cooling cycle, power to the first cooling fan is controlled to be the second reference output when the temperature of the first storage compartment is determined to be higher than a set temperature of the first storage compartment, and wherein power to the first cooling fan is controlled to be a third reference output lower than second reference output when the temperature of the first storage compartment is determined to be less than the set temperature of the first storage compartment.

14. The method of claim 10, wherein during the operating of the third cooling cycle, power to the first cooling fan is controlled to be the second reference output when the temperature of the first storage compartment is determined to be higher than a first reduced reference value, wherein power to the first cooling fan is controlled to be a third reference output lower than second reference output when the temperature of the first storage compartment is determined to be higher than a second reference reduced value, wherein power to the first cooling fan is controlled to be a fourth reference output lower than third reference output when the temperature of the first storage compartment is determined to be lower than a second reference reduced value, wherein the first reduced reference value is higher than the set temperature of the first storage compartment, and wherein the second reduced reference value is less than the set temperature of the first storage compartment.

15. The method of claim 1, further comprising:

in response to a stop condition of the third cooling cycle, performing a pump down operation.

16. The method of claim 15, wherein power to the first cooling fan is controlled to a second initial output during the pump down operation and power to the first cooling fan is reduced one time or more until power to the first cooling fan is stopped.

17. The method of claim 16, wherein during the pump down operation, the power to the first cooling fan is controlled to reduce as time elapses, the power to the first cooling fan is controlled to reduce when the temperature of the first storage compartment is determined to be less than a set value, the power to the first cooling fan is controlled to reduce when a difference value between the temperature of the first evaporator and the temperature of the first storage compartment is determined to be less than a reference difference value, or the power to the first cooling fan is reduced when the temperature of the first evaporator is determined to be higher than a reference temperature value.

18. The method of claim 16, wherein an average power of the first cooling fan after the pump down operation is started is larger than an average power of the first cooling fan during the second cooling cycle, or wherein an operating time of the first cooling fan after the pump down operation is started is larger than an operating time of the first cooling fan during the second cooling cycle.

19. A refrigerator comprising:

a compressor configured to compress refrigerant;

a first evaporator configured to receive refrigerant from the compressor to generate cold air for a first storage compartment;

a first cooling fan configured to supply cold air to the first storage compartment;

a second evaporator to receive refrigerant from the compressor to generate cold air for a second storage compartment;

a second cooling fan configured to supply cold air to the second storage compartment;

a valve configured to selectively open one of a first refrigerant passage connecting the compressor and the first evaporator to allow the refrigerant to flow and a second refrigerant passage connecting the compressor and the second evaporator to allow the refrigerant to flow; and a controller configured to control the first cooling fan, the second cooling fan and the valve, wherein the controller is configured to drive the compressor and control power to the first cooling fan during cooling of the first storage compartment, and to drive the compressor and control of the second cooling fan during cooling of the second storage compartment after cooling of the first storage compartment is completed, wherein the first cooling fan is controlled to operate during cooling of the first storage compartment and cooling of the second storage compartment, and wherein during operating of the first cooling fan and the second cooling fan, power to the first cooling fan is controlled to be reduced stepwise based on an elapse of time or a temperature change in at least one of a temperature of the first storage compartment and a temperature of the first evaporator, wherein after reducing the power of the first cooling fan to a first reduced output power, the power of the first cooling fan is reduced to a second reduced output power which is lower than the first reduced output power.

20. A refrigerator comprising:

a compressor configured to compress refrigerant;

a first evaporator configured to receive refrigerant from the compressor to generate cold air for a first storage compartment;

a first cooling fan configured to supply cold air to the first storage compartment;

a second evaporator to receive refrigerant from the compressor to generate cold air for a second storage compartment;

a second cooling fan configured to supply cold air to the second storage compartment;

a valve configured to selectively open one of a first refrigerant passage connecting the compressor and the first evaporator to allow the refrigerant to flow and a second refrigerant passage connecting the compressor and the second evaporator to allow the refrigerant to flow; and a controller configured to control the first cooling fan, the second cooling fan and the valve, wherein the controller is configured to drive the compressor and control power to the first cooling fan during cooling of the first storage compartment, and to drive the compressor and control of the second cooling fan during cooling of the second storage compartment after cooling of the first storage compartment is completed, wherein the first cooling fan is controlled to operate during cooling of the first storage compartment and cooling of the second storage compartment, and wherein during operating of the first cooling fan and the second cooling fan, power to the first cooling fan is controlled to be reduced to a first reduced output power greater than zero based on an elapse of time or a temperature change in at least one of a temperature of the first storage compartment and a temperature of the first evaporator, and after reducing the power of the first cooling fan to the first reduced output power, the power of the first cooling fan is reduced to a second reduced output power which is lower than the first reduced output power.

* * * * *